United States Patent [19]

Irie et al.

[11] Patent Number: 4,544,419

[45] Date of Patent: Oct. 1, 1985

[54] METHOD FOR PRODUCING HIGH TENSILE STRENGTH COLD ROLLED STEEL SHEETS HAVING EXCELLENT FORMABILITY AND HIGH TENSILE STRENGTH HOT-DIP GALVANIZED STEEL SHEETS HAVING EXCELLENT FORMABILITY

[75] Inventors: Toshio Irie; Susumu Sato; Osamu Hashimoto, all of Chiba, Japan

[73] Assignee: Kawasaki Steel Corporation, Kobe, Japan

[21] Appl. No.: 627,839

[22] Filed: Jul. 5, 1984

Related U.S. Application Data

[62] Division of Ser. No. 328,578, Nov. 27, 1981, Pat. No. 4,473,414.

[30] Foreign Application Priority Data

Mar. 31, 1980 [JP] Japan ..... 55-41844
May 31, 1980 [JP] Japan ..... 55-73178

[51] Int. Cl.[4] ..... C21D 8/04
[52] U.S. Cl. ..... 148/12 C; 148/12.4
[58] Field of Search ..... 148/12 C, 12 F, 36, 148/12.4

[56] References Cited

U.S. PATENT DOCUMENTS 3,368,886 2/1968 Muta ..... 75/125
3,988,173 10/1976 Kawano ..... 148/12 C
4,339,284 7/1982 Hashimoto et al. ..... 148/12 F
4,368,084 1/1983 Irie et al. ..... 148/36

FOREIGN PATENT DOCUMENTS 100920 8/1979 Japan ..... 148/12 F
1040140 8/1966 United Kingdom ..... 148/36

*Primary Examiner*—Peter K. Skiff
*Attorney, Agent, or Firm*—Balogh, Osann, Kramer, Dvorak, Genova & Traub

[57] ABSTRACT

The present invention provides high tensile strength cold rolled steel sheets having excellent formability, which consist of 0.002–0.015% of C, not more than 1.2% of Si, 0.04–0.8% of Mn, 0.03–0.10% of P, 0.02–0.10% and not less than N%×4 of Al, C%×3-{C%×8+0.020%} of Nb and the remainder being substantially Fe, as the high tensile strength steel sheets which reduce the weight of automobiles and the like. The steel sheet is produced by hot rolling a steel slab having the above described composition to obtain a hot rolled coil, in the hot rolling the total reduction rate being at least 90%, the rolling speed in the finishing rolling being at least 40 m/min and the coiling-up temperature being at least 600° C.; cold rolling the above described hot rolled coil in a conventional process to obtain a cold rolled steel strip having a final gauge; subjecting the above described cold rolled steel strip to a continuous annealing at a temperature of 700°–900° C. for 10 sec-5 min and then cooling the annealed strip to 500° C. at a rate of at least 60° C./min. The steel sheets having the above described composition, except that Si is not more than 0.5%, are suitable for the continuous hot-dip galvanizing.

3 Claims, 3 Drawing Figures

METHOD FOR PRODUCING HIGH TENSILE STRENGTH COLD ROLLED STEEL SHEETS HAVING EXCELLENT FORMABILITY AND HIGH TENSILE STRENGTH HOT-DIP GALVANIZED STEEL SHEETS HAVING EXCELLENT FORMABILITY

This is a division of application Ser. No. 328,578, filed Nov. 27, 1981, U.S. Pat. No. 4,473,414.

FIELD OF INVENTION

The present invention relates to high tensile strength cold rolled steel sheets having excellent formability and a method for producing said steel sheets, and particularly to non-ageing high tensile strength cold rolled steel sheets having excellent formability and a tensile strength of about 35–45 kg/mm$^2$ and a method for producing said steel sheets. Furthermore, the present invention relates to non-ageing high tensile strength hot-dip galvanized steel sheets having excellent formability and a method for producing said steel sheets.

BACKGROUND OF INVENTION

Demand of high tensile strength steel sheets has been increased in order to decrease the body weight for improving the fuel cost of automobiles. These steel sheets must satisfy the following various requirements.

1. Non-ageing.
2. $\bar{r}$ value is high.
3. Elongation is high.
4. Yield ratio is low.
5. Inclusions are few and there is no surface defect.
6. Production cost is not high.
7. Hot-dip galvanization is easily carried out.

As the steels satisfying these requirements, dual phase steel composed or martensite-ferrite two phase alloy structure and rephos-steel in which P, Mn, Si and the like are added to aluminium killed steel have been developed but these steels are poor in the formability and therefore cannot be used in the portions where the deep drawing is carried out, such as automobile fenders. Furthermore, these steels contain a number of elements, such as Si, Cr, Mn and the like which retard the plating ability, so that the hot-dip galvanization cannot be easily effected.

Furthermore, it has been proposed that Ti or Nb having a high affinity to C and N is incorporated in an amount of more than stoichiometric equivalent based on an amount of C or C+N to fix C and N and Mn or Si is incorporated as a solid solution reinforcing element to obtain a steel sheet having high $\bar{r}$ value and tensile strength. For example, it has been reported in "Iron and Steel", 1979, No, 11, p. 838 that an extremely low carbon steel having less than 0.01% of C which contains 0.25% of Ti, 1.5% of Mn and 0.22% of Si is continuously annealed to obtain a steel having high formability which has a tensile strength (abbreviated as TS hereinafter) of 43 kg/mm$^2$, an yield point (abbreviated as YP hereinafter) of 22–25 kg/mm$^2$, $\bar{r}$ value of 1.8 and an elongation of 39%. However, this steel has a demerit that Ti combines with not only C and N in the steel but also S and O, so that a large amount of inclusions are formed and the surface defects are liable to be formed. Moreover, amounts of Mn, Si and Ti added are larger and it is necessary to add a large amount of alloy to effect decarburization refining to decrease c in the molten steel to less than 0.01%, so that this steel has a demerit that the cost of alloy and decarburization is higher.

Furthermore, it has been proposed in Japanese Patent Laid-Open Application No. 100,920/79 that high tensile strength steels having TS of 42–46 kg/mm$^2$, YP of 28–30 kg/mm$^2$, $\bar{r}$ value of 1.6–1.8 and an elongation of 32–35% are obtained by subjecting a steel containing 0.004% of C, 1.01% of Si, 0.22% of Mn, 0.025% of Al and 0.049% of Nb to a continuous annealing and then to an over ageing treatment at 400° C. for 3 minutes, but $\bar{r}$ value and the elongation are low, so that the formability is not satisfactory.

SUMMARY OF INVENTION

An object of the present invention is to provide high tensile strength cold rolled steel sheets having excellent formability in which the above described various defects in the prior high tensile strength steel sheets are obviated and a method for producing said steel sheets. A further object of the present invention is to provide hot-dip galvanized high tensile strength cold rolled steel sheets having excellent formability and a method for producing said steel sheets.

The present invention consists in high tensile strength cold rolled steel sheets having excellent formability, which consist of 0.002–0.015% of C, not more than 1.2% of Si, 0.04–0.8% of Mn, 0.03–0.10% of P, 0.02–0.10% and not less than N%×4 of Al, C%×3 to {C%×8+0.020%} of Nb and the remainder being substantially Fe, and in a method for producing the high tensile strength cold rolled steel sheets having excellent formability which comprises hot rolling a steel slab having the above described composition, in said hot rolling the total reduction rate being at least 90%, the rolling speed in the finishing rolling being at least 40 m/min, and the coiling-up temperature being at least 600° C., cold rolling the above described hot rolled coil in a conventional process to obtain a cold rolled steel strip having a final gauge, subjecting the above described cold rolled steel strip to a continuous annealing at a temperature of 700°–900° C. for 10 sec-5 min and then cooling the annealed strip to 500° C. at a rate of at least 60° C./min.

In addition, the present invention consists in hot-dip galvanized high tensile strength cold rolled steel sheets having excellent formability, which have the same composition as described above except that Si is not more than 0.5%, and in a method for producing non-ageing high tensile strength hot-dip galvanized steel sheets having excellent press formability which includes hot rolling a steel slab having the above described composition, in the hot rolling the total reduction rate being at least 90%, the rolling speed in the finishing rolling being at least 40 m/min and the coiling-up temperature being at least 600° C., cold rolling the hot rolled coil in a conventional manner to obtain a cold rolled steel strip having the final gauge, soaking the cold rolled steel strip at a temperature range of 700°–900° C. for 10 sec-5 min, cooling the heated steel strip at a rate of at least 60° C./min and continuously hot-dip galvanizing the cooled steel strip.

The present invention will be explained in greater detail herinafter.

The inventors have studied in detail the influence of the material components and the hot rolling conditions upon the ageing property and the deep drawing property of the extremely low carbon steels and the influence of the amounts of P, Si and Mn added for improving the tensile strength and the finish annealing conditions upon the deep drawing property and the cold work embrittlement and the following facts have been found.

(1) When the steel having Al content which is at least 4 times of N amount and is at least 0.02%, is hot rolled at a reduction rate of at least 90%, a rolling speed of at least 40 m/min and a coiling-up temperature of 600°–750° C., if an amount of Nb added with respect to C is about at least ⅓ of the equivalent as NbC, the cold rolled and annealed product shows the non-ageing property.

(2) The steel in which the solid solute Nb not combined with C is less than 0.020%, is larger in the elongation and is equal in $\bar{r}$ value as compared with the steel containing the larger amount of Nb.

(3) When to the steel in which an amount of Nb is about at least ⅓ of the equivalent based on C and the uncombined Nb is not more than 0.020%, are alone added P, Si and Mn respectively, the decrease of $\bar{r}$ value is most remarkable in Mn and the decrease of $\bar{r}$ value due to the addition of Si is next and the influence of P is smallest.

(4) When the extemely low carbon steel added with at least 0.05% of P is subjected to batch annealing, the cold work embrittlement after press working is caused but when the continuous annealing is effected at a cooling rate of at least 1° C./sec, even if P of not more than 0.10% is contained, the cold work embrittlement is not caused.

(5) When at least 0.03% of P is contained, if not more than 0.8% of Mn or not more than 1.2% of Si is contained, the deterioration of $\bar{r}$ value is low and the high tensile strength is obtained.

(6) The hot-dip galvanizing property of the steel sheets containing Nb, P and Mn within the above described composition range is satisfied when the Si content is not more than 0.5%.

The present invention has been accomplished by obtaining the above described novel discoveries (1)–(6).

Then, the present invention is explained together with the reason of limitation of the component composition with respect to the experimental data.

TABLE 1

| C | Si | Mn | p | S | O | Sol Al | Total N |
|---|---|---|---|---|---|---|---|
| 0.003 to 0.010 | 0.01 | 0.15 | 0.05 | 0.01 | 0.004 | 0.035 | 0.004 |

| Nb | Nb(%)/C(%) | Nb(%)-8C(%) |
|---|---|---|
| 0.011 to 0.10 | 1.6 to 18.4 | −0.042 to 0.033 |

The steels having the composition (wt%) shown in the above table were heated at 1,250° C. and then hot rolled at a reduction rate of 90%, a rolling speed of 40 m/min, a finishing temperature of 870° C. and a coiling-up temperature of 680° C. and cold rolled at a reduction rate of 80% to a final gauge and the cold rolled steel sheets were subjected to continuous annealing at 830° C. for 40 seconds and the relations of parameter $\alpha \equiv N(\%)/C(\%)$ and parameter $\beta \equiv Nb(\%)-8C(\%)$ to the properties (AI value, El value, $\bar{r}$ value) of the thus formed products are shown in FIGS. 1–3.

It can be seen from FIGS. 1–3 that in parameter $\alpha$ of more than 3, AI value that is ageing index, is lower than 1 kg/mm² and $\bar{r}$ value is higher than 1.9 and non-ageing steels having high $\bar{r}$ value are obtained and that El value that is the elongation, varies depending upon parameter $\beta$ and when $\beta$ is not more than 0.02%, the satisfactorily high value is obtained. From the repeated experiments, Nb must be at least 3 times of C(%) but $\beta \equiv Nb(\%)-8C(\%)$, that is Nb(%) not combined with C must be not more than 0.02. Nb content is preferred to be within the range of 0.03–0.06% and more preferably within the range of $6\times C\%-\{8\times C\%+0.010\%\}$.

C when P coexists is an element having effect for preventing the grain boundary brittleness and when C is less than 0.002%, C has no the above described effect, while when C is more than 0.015%, the decrease of $\bar{r}$ value and elongation become remarkable, so that C should be within a range of 0.002–0.015%.

Al should be added in an amount of at least 0.02% and at least 4 times of N(%) for fixing N as AlN. Otherwise, N in the steel combines with Nb in the steel, so that a large amount of C which is not fixed with Nb, remains in the steel and AI value cannot be satisfactorily decreased. However, the addition of Al of more than 0.1% increases the inclusions due to alumina clusters in the steel resulting into formation of surface defects, so that such an amount should be avoided.

P is used as the main reinforcing element. It has been found from experiments that P is lower in the influence of decrease of $\bar{r}$ value for the increase of the tensile strength than the other reinforcing elements of Si and Mn, and that in the steels containing about 0.05% of P, when the same level of Mn or Si is alloyed, $\bar{r}$ value is higher than the steels having a lower content of P, which are not particularly added with P.

The experimental data of the variation of YP, TS, El, $\bar{r}$ and AI when 0.01% of P, 0.1% of Si and 0.1% of Mn are respectively added to the steel containing 0.005% of C and 0.03% of Nb are shown in the following Table 2.

TABLE 2

| | Variation in addition of 0.01% of P | Variation in addition of 0.1% of Si | Variation in addition of 0.1% of Mn |
|---|---|---|---|
| YP (kg/mm²) | +0.9 | +1.0 | +1.0 |
| TS (kg/mm²) | +1.0 | +0.9 | +0.8 |
| El (%) | −0.8 | −0.7 | −0.8 |
| $\bar{r}$ | −0.016 | −0.030 | −0.049 |
| AI (kg/mm²) | +0.06 | +0.11 | +0.05 |

When an amount of $\bar{r}$ decreased with respect to the increased amount of TS is calculated from the data in Table 2, as shown in the most left column in the above table, the value in the case of P is smallest.

The influence of an added amount of 0.1% of each of Si and Mn upon various properties of a steel containing about 0.05% of P was examined and the obtained results are shown in the following Table 3.

TABLE 3

| | Variation in addition of 0.1% of Si to a steel added with 0.05% of P | Variation in addition of 0.1% of Mn to a steel added with 0.05% of P |
|---|---|---|
| YP (kg/mm²) | +0.9 | +0.9 |
| TS (kg/mm²) | +1.0 | +1.0 |
| El (%) | −0.8 | −0.9 |
| $\bar{r}$ | −0.026 | −0.038 |
| AI | +0.07 | +0.05 |

TABLE 3-continued

| | Variation in addition of 0.1% of Si to a steel added with 0.05% of P | Variation in addition of 0.1% of Mn to a steel added with 0.05% of P |
|---|---|---|
| (kg/mm²) | | |

When the data in Table 3 wherein P is added together with Si or Mn are compared with the data of a steel having a low content of P in Table 2, it can be seen that the steel wherein P is added together with Si or Mn is lower in the decreased ratio of $\bar{r}$ value with respect to the increased ratio of TS than the steel having lower content of P. In order to obtain a tensile strength of more than 35 kg/mm², which is the practically desirable strength level, P should be at least 0.03%. However, when P exceeds 0.1%, the cold work embrittlement is caused, so that P should be not more than 0.1% and although P content depends upon the strength level, the amount of 0.05–0.09% is generally preferable.

Si is added in an amount of not more than 1.2% as a reinforcing element, but when the hot-dip galvanization is carried out, Si content is preferred to be 0.50%. Furthermore, Mn is used in an amount of 0.04–0.8% in order to fix S in the steel and to increase the strength of the steel but as mentioned above, the tendency of decreasing $\bar{r}$ value and the elongation is more remarkable than P, so that such an element is used secondarily. As the amount of P, Si and Mn added is increased, AI may become more than 1 kg/mm² but if the added amount is within the above described composition range, AI is less than 3 kg/mm² and the steels are substantially non-ageing. Even when the amount of P, Si and Mn added is high, if Nb/C is increased, it is possible to make AI less than 1 kg/mm².

Standard composition and properties when the steel sheets having tensile strength (TS) of 34–48 kg/mm² are produced, are shown in Table 4. Furthermore, the production of hot-dip galvanized steel sheets having TS of more than 44 kg/mm² can be attained by making Si content less than 0.5% and increasing Mn content.

TABLE 4

| TS (kg/mm²) | $\bar{r}$ | El (%) | % P | % Si | % Mn |
|---|---|---|---|---|---|
| 34 to 38 | more than 1.8 | more than 40 | 0.04 to 0.09 | not more than 0.3 | 0.05 to 0.30 |
| 39 to 43 | more than 1.7 | more than 37 | 0.05 to 0.10 | not more than 0.5 | 0.2 to 0.6 |
| 44 to 48 | more than 1.5 | more than 35 | 0.05 to 0.10 | 0.3 to 1.2 | 0.2 to 0.8 |

If the contents of C, Nb, Al, P, Si and Mn in the component composition of the steel sheets of the present invention are within the above described range, concerning the other elements, it is merely necessary that the conditions required to the general cold rolled steel sheets are satisfied, that is, S is not more than 0.02%, N is not more than 0.01% and O is not more than 0.008%. In addition, as the deoxidizing element, a slight amount of rare earth elements or Ca may be contained and used and a small amount of Mo, Cu, Ni and Cr may be contained.

Then, the production method of the present invention will be explained.

In the production of the steel sheets of the present invention, any conventional process can be used alone or in combination. However, the decarburization must be previously carried out in the melting stage and as the means therefor vacuum decarburizing treatments, such as RH process, DH process and the like are advantageous. Furthermore, it is advantageous to directly produce extremely low carbon steel by pure oxygen bottom blown converter process (Q-BOP process). Furthermore, anyone of ingot forming process and continuous casting process may be used.

A slab produced through a continuous casting or a slab produced by blooming of a steel ingot produced by a prior process for producing ingot is applied to a continuous hot rolling. In this case, the temperature for heating the slab is merely necessary to be higher than 1,150° C. which is necessary to form a solid solution of NbC in the steel and the general temperature range is 1,150°–1,300° C.

In the present invention, the reduction rate and the rolling speed in the continuous hot rolling should be limited. That is, the reduction rate should be limited so that the total reduction rate during the period when a slab passes through a rough mill and gets out a finishing rolling stand group becomes not less than 90%. The rolling speed in the finishing stand should be at least 40 m/min.

When the above described conditions of the reduction rate and the rolling speed are satisfied, fine, for example, less than 1,000 Å of composite precipitates composed of Nb(C, N), AlN and MnS are very densely present in the course of rolling and C in the steel is present stably around these precipitates and substantially non-ageing steel sheets can be obtained.

On the other hand, when the reduction rate is less than 90% or the rolling speed is lower than 40 m/min, the above described phenomenon does not occur and non-ageing steel sheets cannot be obtained.

In the present invention, the hot rolling finishing temperature should be at least 850° C. When the finishing temperature lower than this temperature is adopted, $\bar{r}$ value, the elongation and the ageing property are deteriorated.

In the present invention, the coiling-up temperature should be at least 600° C. When the coiling-up temperature is lower than this temperature, the fixing of C with Nb or the fixing of N with Al becomes unsatisfactory and the non-ageing steel sheets cannot be obtained. The high coiling-up temperature, that is the range of 640°–750° C. is advantageous in view of AI value, $\bar{r}$ value and El value and in order to make the coiling-up temperature within this temperature range, it is possible to take the means in which the water cooling after the finishing rolling is weakened or the water cooling is completely omitted.

The thus obtained hot rolled cooil is subjected to pickling to remove oxidized scales following to the conventional process and then cold rolled or alternatively cold rolled and then pickled or polished to remove scales. When the reduction rate in the cold rolling is less than 60%, the desired $\bar{r}$ value cannot be obtained, while when the reduction rate exceeds 90%, $\bar{r}$ value becomes higher but the anisotropy becomes larger, so that the reduction rate in the cold rolling is particularly preferable to be 70–85%.

According to the present invention, the thus obtained cold rolled steel sheet is further subjected to a continuous annealing. The annealing temperature and time may be selected properly within the range of 700°–900° C. and 10 seconds-5 minutes depending upon the aimed material. Within the temperature range of 700°–900° C., as the temperature is higher, the strength is lower but $\bar{r}$ value and the elongation are higher. The soaking at 750°-850° C. for 30-90 seconds is particularly preferable.

After the above described soaking and recrystallization, the steel strip is cooled to room temperature. In this case, unless the cooling rate is at least 60° C./min up to 500° C., the cold work embrittlement occurs due to the grain boundary segregation of P.

However, if the cooling rate exceeds 100° C./sec, for example, by cooling with water, the ageing resistance is deteriorated, that is AI value becomes higher. However in this case it can be overcome by an additional over ageing treatment at 300°-500° C.

After all, the cooling is advantageous to be not less than 60° C./min, preferably 5°-80° C./sec. In order to prevent the brittleness due to P, it is particularly advantageous to effect rapid cooling in the temperature range of 750°-600° C. in the above described cooling rate in the cooling after the soaking.

According to the present invention, the steel sheets have non-ageing property and no yield elongation in the state where the continuous annealing has been effected, but it is acceptable to apply a skin pass rolling of less than 2%, preferably less than 1% in order to adjust the surface roughness. In the present invention, when the hot-dip galvanization is carried out, such a step is carried out as follows. In the continuous galvanizing, the cold rolled steel sheet is firstly subjected to continuous annealing and the soaking temperature and time can be properly selected depending upon the aimed material quality within the ranges of 700°-900° C. and 10 sec-5 min.

The above described soaking is carried out by using the continuous plating line and immediately after the soaking, the annealed steel sheet is dipped in the galvanizing bath but the cooling rate after the above described soaking until dipping into the galvanizing bath must be at least 60° C./min. Otherwise, the cold work embrittlement resulting from the grain boundary segregation of P cannot be avoided. This cooling rate is preferred to be 3°-50° C./sec (180°-3,000° C./min).

In the present invention, the galvanizing means may be a conventional continuous hot-dip galvanizing means and the type or the galvanizing bath composition is not particularly limited. Alternatively, after the galvanization, an alloying treatment (galvanneal) may be carried out following to the conventional manner. If the cooling rate after the galvanization or the succeeding alloying treatment is within the usual range, there is no problem.

The hot-dip galvanized steel sheets according to the present invention are non-ageing but in order to adjust the surface or correct the shape, it is acceptable to carry out the skin pass rolling of less than 2%, preferably less than 1%. When a ratio of Nb incorporated to C is low, the yield point is lowered owing to the skin pass rolling.

By carrying out the above described galvanization, the material qualities can be reduced 0.1-0.2% in $\bar{r}$ value and 1-3% in the elongation as compared with those when the galvanization is not effected.

DESCRIPTION OF THE PREFERRED EMBODIMENTS

EXAMPLE 1

Figure 1:
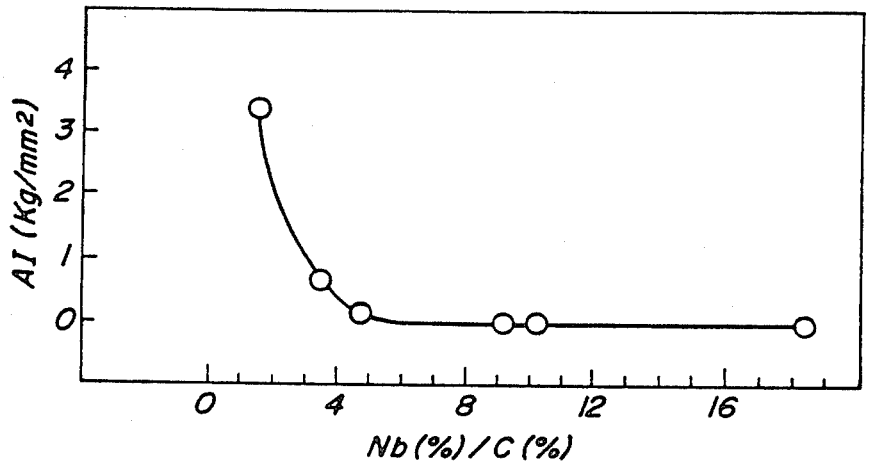
FIG. 1 is a graph showing the relation of AI value to Nb(%)/C(%) of the steel sheets.
Figure 2:
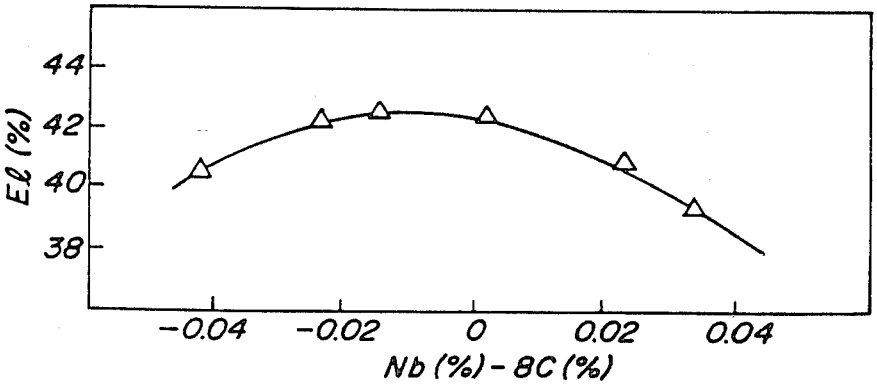
FIG. 2 is a graph showing the relation of El(%) to Nb(%)-8C(%) of the steel sheets.
Figure 3:
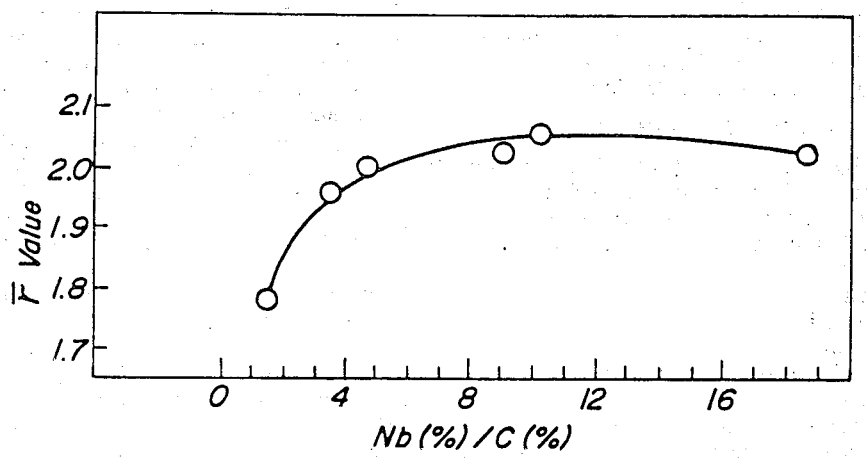
FIG. 3 is a graph showing the relation of $\bar{r}$ value to Nb(%)/C(%) of the steel sheets.

Three kinds of steels I, II and III having the composition shown in Table 5 were produced through the production steps (1), (2), (3) and (4) described below.

TABLE 5

| | Composition (Checked in cold rolled steel sheet) wt % | | | | | | | | | |
|---|---|---|---|---|---|---|---|---|---|---|
| | C | Si | Mn | P | S | O | Total N | sol Al | Nb | Nb/C |
| I | 0.005 | 0.011 | 0.14 | 0.062 | 0.009 | 0.0045 | 0.0038 | 0.040 | 0.037 | 7.4 |
| II | 0.007 | 0.013 | 0.061 | 0.070 | 0.011 | 0.0026 | 0.0041 | 0.035 | 0.027 | 3.9 |
| III | 0.009 | 0.54 | 0.50 | 0.082 | 0.006 | 0.0028 | 0.0029 | 0.032 | 0.043 | 4.8 |

(1) Steel making, ingot formation:

Steels I and III were molten and produced in 100 tons in pure oxygen upper blown converter (LD converter) and Steel II was molten and produced in 230 tons in pure oxygen bottom-blown converter (Q-BOP). Thereafter, any molten steels were subjected to decarburization and deoxidation through RH degassing treatment. The treating time in Steels I and II was 25 minutes and that in Steel III was 35 minutes. The addition of P and Mn was effected just before starting the degassing treatment and the addition of Si, Al and Nb was carried out just before finishing the degassing treatment.

Steels I and III were made into slabs having a thickness of 220 mm through a continuous casting process and Steel II was made into a slab having a thickness of 220 mm through a slabbing process.

(2) Hot rolling:

The above described three slabs were subjected to a surface treatment and then soaking at 1,280° C. (surface temperature) for 35 minutes in a heating furnace. Successively, the slabs were continuously rolled through 4 series rough mills and 7 tandem finishing mills. The slabs were made into sheet bars having a thickness of 40 mm through rough mills and then into hot rolled steel strips having a thickness of 3.2 mm through a finishing mill. In this case, the total reduction rate from the sheet bars to the hot rolled steel strip was 92%. The rolling speed (substantially corresponding to the speed of the strip at the tandem roll outlet side) in the finishing mill was 98 m/min in the first stand and 660 m/min in the seventh stand.

The temperature of the sheet bars at the inlet side of the finishing mill was 1,030°-1,050° C. and the finishing temperature was 880°-910° C.

The coiling-up temperature of the hot rolled steel strips was 760° C. in Steel I, 660° C. in Steel II and 700° C. in Steel III.

(3) Cold rolling:

The hot rolled steel strips were pickled and cold rolled to obtain cold rolled coils having a thickness of 0.7 mm and the reduction rate in this case was 78%.

(4) Recrystallizing annealing:

The cold rolled coils were cleaned and then subjected to recrystallizing annealing in a continuous annealing line. The soaking condition was 800°–830° C., 30 seconds in Steel I, 820°–860° C., 40 seconds in Steel II and 800°–830° C., 25 seconds in Steel III. The cooling rate after the soaking was 15°–20° C./sec.

The annealed coils passed through the above described step were subjected to 0.6% of temper-rolling to obtain the products. The mechanical properties of the products are shown in the following Table 6.

TABLE 6

| | Mechanical properties | | | | |
|---|---|---|---|---|---|
| | YP (kg/mm²) | TS (kg/mm²) | El (%) | $\bar{r}$ | AI (kg/mm²) |
| I | 23 | 37 | 44 | 2.2 | 0 |
| II | 25 | 41 | 40 | 1.9 | 1.3 |
| III | 28 | 46 | 36 | 1.7 | 2.4 |

In each of Steels I, II and III, non-ageing high tensile strength cold rolled steel sheets having excellent formability of TS of 35 kg/mm² class, 40 kg/mm² class and 45 kg/mm² class were obtained. Any steel sheets had the properties comparable with the general Al killed steel sheets as the result of surface inspection and there were no problem in the use.

According to the present invention, P can be utilized as a strengthening element as mentioned above, so that the amount of Si and Mn added is small and the cost for removing phosphorus in the molten steel is low and therefor the total cost of the material is low and the over ageing treatment after the continuous annealing is not necessary inspite of DDQ class of drawing steel sheets, so that the annealing cost is low.

EXAMPLE 2

(Production of hot-dip galvanized steel sheet)

(A) Steel making, ingot formation:

After treating in pure oxygen upper blown converter (LD converter), RH degassing was effected and continuous casting was carried out to obtain Steels I and II having a thickness of 220 mm and the composition shown in the following Table 7. In the above described refining, P and Mn were added just before starting the degassing and Nb and Al were added just before finishing the degassing.

(B) Hot rolling:

The slabs after surface treating were subjected to soaking at 1,280° C. for 35 minutds (Steel I) and at 1,300° C. for 30 minutes (Steel II). The thus treated slabs were continuously rolled through 4 series of rough mills and 7 tandem finishing mills to obtain steel strips having a thickness of 3.2 mm. The reduction rate from the slabs to the finally hot rolled steel strips was 98.5%. The rolling speed (substantially corresponding to the speed of the strips at the outlet of the tandem roll) in the finishing mill was 98 m/min in the first stand and 660 m/min in the seventh stand in Steel I, and was 103 m/min in the first stand and 745 m/min in the seventh stand in Steel II. The finishing temperature was 890°–920° C. and the coiling-up temperature was 680° C. in Steel I and 750° C. in Steel II.

(C) Cold rolling, CGL annealing:

The hot rolled steel strips were pickled and then cold rolled into a thickness of 0.8 mm (reduction rate: 75%). The cold rolled coils were passed through CGL (continuous hot-dip galvanizing line) under the following condition.

Steel I: The soaking was effected at 850°–870° C. for 40 seconds and then the steel coil was cooled at 3.5° C./sec to about 500° C. and dipped in a galvanizing bath at 470° C.

Steel II: The soaking was effected at 810°–830° C. for 30 seconds and then the steel coil was cooled at 5° C./sec to about 500° C. and dipped in a galvanizing bath at 465° C.

Successively, an alloying treatment was carried out at 580° C. for 10 seconds.

TABLE 7

| Steel | Composition (Checked in cold rolled steel sheet) wt % | | | | | | | | | |
|---|---|---|---|---|---|---|---|---|---|---|
| No. | C | Si | Mn | P | S | O | Total N | sol Al | Nb | Nb/C |
| I | 0.005 | 0.011 | 0.14 | 0.042 | 0.009 | 0.0042 | 0.0035 | 0.039 | 0.028 | 5.6 |
| II | 0.007 | 0.009 | 0.60 | 0.060 | 0.012 | 0.0030 | 0.0039 | 0.042 | 0.042 | 6.0 |

The annealed coils passed through the above described steps were subjected to 0.6% of temper-rolling to obtain the products. The mechanical properties of the products are shown in the following Table 8.

TABLE 8

| | Mechanical properties | | | | |
|---|---|---|---|---|---|
| Steel No. | YP (kg/mm²) | TS (kg/mm²) | El (%) | $\bar{r}$ | AI (kg/mm²) |
| I | 22 | 36 | 43 | 2.0 | 0.3 |
| II | 26 | 41 | 40 | 1.7 | 1.7 |

The results of the plating properties are shown in the following Table 9.

TABLE 9

| | | | Plating adhesion | |
|---|---|---|---|---|
| Steel No. | Plating process | Plating property | Bending test | du Pont impact test |
| I | Hot-dip galvanized | | | |
| II | Hot-dip galvannealed | | | |

Note:
means the case where comparison was effected with rimmed steel which is good in the plating property and there was no difference in naked eye judgement.

As seen from the above described Tables 8 and 9, and high tensile strength hot-dip galvanized steel sheets having tensile strength of 35 kg/mm² class, and 40 kg/mm² class, and excellent formability and plating properties can be obtained.

As mentioned above, the steel sheets of the present invention are non-ageing high tensile strength hot-dip galvanized steel sheets having excellent press formability.

We claim:

1. A method for producing high tensile strength cold rolled steel sheets having excellent formability, a tensile strength of more than 35 kg/mm² and a $\bar{r}$ value larger than 2, and which comprises hot rolling a steel slab consisting of 0.002–0.015% of C, not more than 1.2% of Si, 0.04–0.8% of Mn, 0.03–0.10% of P, 0.02–0.10% and not less than N%×4 of Al, C%×3−{C%×8+0.020%} of Nb and the remainder being substantially Fe and unavoidable impurities, to obtain a hot rolled coil, in said hot rolling the total reduction rate being at least 90%, the rolling speed in the finishing rolling being at least 40 m/min and the coiling-up temperature being at least 600° C., cold rolling the above-described hot rolled coil in a conventional process to obtain a cold rolled steel strip having a final gauge, subjecting the cold rolled steel strip to a continuous annealing at a temperature of 700°–900° C. for 10 sec–5 min and then cooling the annealed strip to 500° C. to a rate of at least 60° C./min.

2. A method for producing high tensile strength cold rolled steel sheets having excellent formability as claimed in claim 1, wherein Si in the composition of the steel slab is not more than 0.5%.

3. A method for producing non-ageing high tensile strength hot-dip galvanized cold rolled steel sheets having excellent press formability, a tensile strength of more than 35 Kg/mm$^2$ and a $\bar{r}$ value larger than 2, and which comprises hot rolling a steel slab consisting of 0.002–0.015% of C, not more than 0.50% of Si, 0.04–1.2% of Mn, 0.03–0.10% of P, 0.02–0.10% and not less than N%×4 of Al, 0.01–0.08% and C%×3−{C%×8+0.020%} of Nb and the remainder being substantially Fe and unavoidable impurities, to obtain a hot rolled coil, in said hot rolling the total reduction rate being at least 90%, the rolling speed in the finishing rolling being at least 40 m/min and the coiling-up temperature being at least 600° C., cold rolling the above-described hot rolled coil in a conventional process to obtain a cold rolled steel strip having a final gauge, subjecting the cold rolled steel strip to a soaking at a temperature of 700°–900° C. for 10 sec–5 min, then cooling the soaked strip at a rate of at least 60° C./min and continuously hot-dip galvanizing the cooled strip.

* * * * *